US005844133A

United States Patent [19]

Goto et al.

[11] Patent Number: 5,844,133

[45] Date of Patent: Dec. 1, 1998

[54] DRILLING CONTROL APPARATUS OF ROCK DRILL

[75] Inventors: Kazuya Goto, Tano-gun; Masashi Yanagisawa, Kanra-gun; Toshihiko Gomi, Tano-gun, all of Japan

[73] Assignee: Furukawa Co., Ltd., Tokyo, Japan

[21] Appl. No.: 915,223

[22] Filed: Aug. 20, 1997

[30] Foreign Application Priority Data

Aug. 21, 1996 [JP] Japan ..... 8-219992

[51] Int. Cl.[6] ..... E21B 44/00

[52] U.S. Cl. ..... 73/152.54; 73/152.46; 175/24

[58] Field of Search ..... 73/152.46, 152, 73/48, 152.49, 152.51, 152.54, 152.59; 173/11; 175/24

[56] References Cited

U.S. PATENT DOCUMENTS

| | | | |
|---|---|---|---|
| 3,670,826 | 6/1972 | Hanson et al. . | |
| 4,157,231 | 6/1979 | Phillips . | |
| 4,246,973 | 1/1981 | Mayer | 173/8 |
| 4,354,233 | 10/1982 | Zhukpovsky et al. . | |
| 4,510,801 | 4/1985 | Quigley et al. | 73/152.49 |
| 4,941,951 | 7/1990 | Sheppard et al. | 73/152.48 |
| 5,318,136 | 6/1994 | Rosewsell et al. | 175/24 |

FOREIGN PATENT DOCUMENTS

| | | |
|---|---|---|
| 97114060 | 12/1997 | European Pat. Off. . |
| WO9212329 | 7/1992 | WIPO . |
| WO9219841 | 11/1992 | WIPO . |

OTHER PUBLICATIONS

Shigen–To–Soza; vol. 112 (1996) No. 8 issued by Journal of the Mining and Materials Processing Institute of Japan, pp. 573–574 with English translation (1996).

*Primary Examiner*—Max H. Noori
*Attorney, Agent, or Firm*—Young & Basile, P.C.

[57] ABSTRACT

A drilling control apparatus for automatically controlling the drilling operation of a rock drill includes a control unit for storing known criteria drilling patterns for various rock properties. A specific drilling pattern is selected based upon a collaring procedure for operation of the rock drill. A detector continually monitors variables such as rotational pressure, feed pressure and flushing pressure during the drilling process to determine a change in condition of the rock for determination of automatic selection of another more appropriate drilling pattern.

9 Claims, 7 Drawing Sheets

DRILLING CONTROL APPARATUS OF ROCK DRILL

BACKGROUND OF THE INVENTION

1. Field of the Invention

The present invention relates to a drilling control apparatus capable of automatically controlling a rock drill mounted on a drilling apparatus such as a crawler drill or the like.

2. Description of the Related Art

In a drilling apparatus such as a crawler drill or the like which is used in a drilling work at a spot of a mine, a quarry, a construction working or the like, the drilling is performed by transmitting an impacting force and a rotational force to a bit attached to a rod end from a rock drill mounted on a guide shell, and by advancing the rock drill.

In a general procedure of drilling, first, a start collaring operation is performed to position the bit end, and subsequently, a collaring operation is performed to position the drilling and to prevent the curving of the hole, and then a regular drilling operation is performed. In the case of performing a long hole drilling, when the drilling of a length of one rod is finished, another rod is added to the rod, and the addition of the rod is repeated until a predetermined hole length is reached.

In such a drilling work, the operator grasps the operating condition of each operating mechanism of the rock drill by visual and aural observation and judges, during the collaring the property of the rock which is the object of the drilling, and starts the regular drilling by adjusting an operating condition of each operating mechanism according to the property of the rock. Since the property of the rock which is the object of the drilling is not constant but varies, the operator, also thereafter always grasps the operating condition of each operating mechanism and judges a variation of the property of the rock, and each time the drilling condition varies, manipulates and adjusts manipulation equipment such as hydraulic valves and electrical switches so as to enable to quickly drill with a minimum load incurred on the rock drill, the rod, and the bit.

However, since such a drilling work requires to always monitor the operating condition of the rock drill and to adjust the operation, the fatigue of the operator increases. Furthermore, the work to grasp the operating condition of each operating mechanism of the dock drill by visual and aural observation during drilling and to judge the property of the rock involves a large individual difference depending on the skill level of the operator, and the non-uniformity is apt to be caused in the drilling efficiency, the linearity of drilling, the finish of hole wall, etc., in particular in the drilling precision. When the drilling precision is decreased, a difference between the planed drilling pattern and the actual drilling pattern is increased, and the crushing cannot be performed uniformly.

SUMMARY OF THE INVENTION

The present invention solves the problems in the prior art drilling control of the rock drill, and it is an object of the invention to provide a drilling control apparatus of a rock drill which enables to reduce the fatigue of the operator by automating the drilling control, and to achieve the stable drilling precision and drilling efficiency without being affected by the skill level of the operator.

The drilling control apparatus of a rock drill according to the present invention comprises detection means for detecting an operating condition of an impacting mechanism, a rotating mechanism, a feed mechanism, and a flushing mechanism of the rock drill mounted movably forward and backward on a guide shell, and a control unit for controlling a drilling operation of the rock drill by judging a drilling condition on the basis of detection data from the detecting means.

At the time of drilling work, when the operator commands a start of drilling by designating a drilling length, the rock driller starts advancement on the basis of program data of a drilling procedure stored in the control unit. When an end of the bit reaches the rock which is the object of crushing, this arrival position on the rock is detected by the detecting means, and inputted as a zero point of the drilling length into the control unit, and thereafter the drilling length is obtained by using this zero point as a reference.

After detecting the arrival at the rock, a start collaring operation to perform positioning of the end of the bit is started, and when a predetermined length of start collaring has been performed, the finish of the start collaring is detected, and a collaring is started. When a predetermined length of collaring has been performed, the finish of the collaring is detected. Then, a real drilling is started.

In the case of performing the drilling of a long hole, when the drilling of one-rod length is finished, another rod is added to the rod now in use, and the drilling and the addition of rod are repeated until a designated drilling length is reached.

During the drilling, the situation including whether the rock is hard or soft, a crack is present or not, etc., is judged by the control unit on the basis of the detection data, and if there is any change, the setting of the drilling conditions is changed.

The conditions for the drilling operation at the time of start of the real drilling are set by the control unit by judging the property of the rock on the basis of the detection data obtained in the collaring, and thus it is possible to instantly perform an appropriate regular drilling.

The control unit judges the presence or absence of an abnormality in the drilling operation such as an increase in rotational resistance and a blocking of a bit hole, etc., on the basis of the detection data including a rise in rotational pressure and a rise in a flushing pressure or the like during drilling, and in the case of abnormality, the operation for abnormality avoidance such as retraction of the rock drill or the like is performed thereby to prevent expansion of the drilling failure and to return the rock drill to a normal drilling condition at an early stage.

The control unit is arranged, during temporary stopping of the drilling operation, to store a drilling condition before the stopping, and at the time of restart of the drilling operation, to set the conditions for the drilling operation in a similar manner as before the stopping. Accordingly, even when the drilling operation is stopped temporary due to the adding work of the rod, or the like, it is possible to restart the drilling operation in an appropriate condition.

DESCRIPTION OF THE PREFERRED EMBODIMENTS

Figure 1:
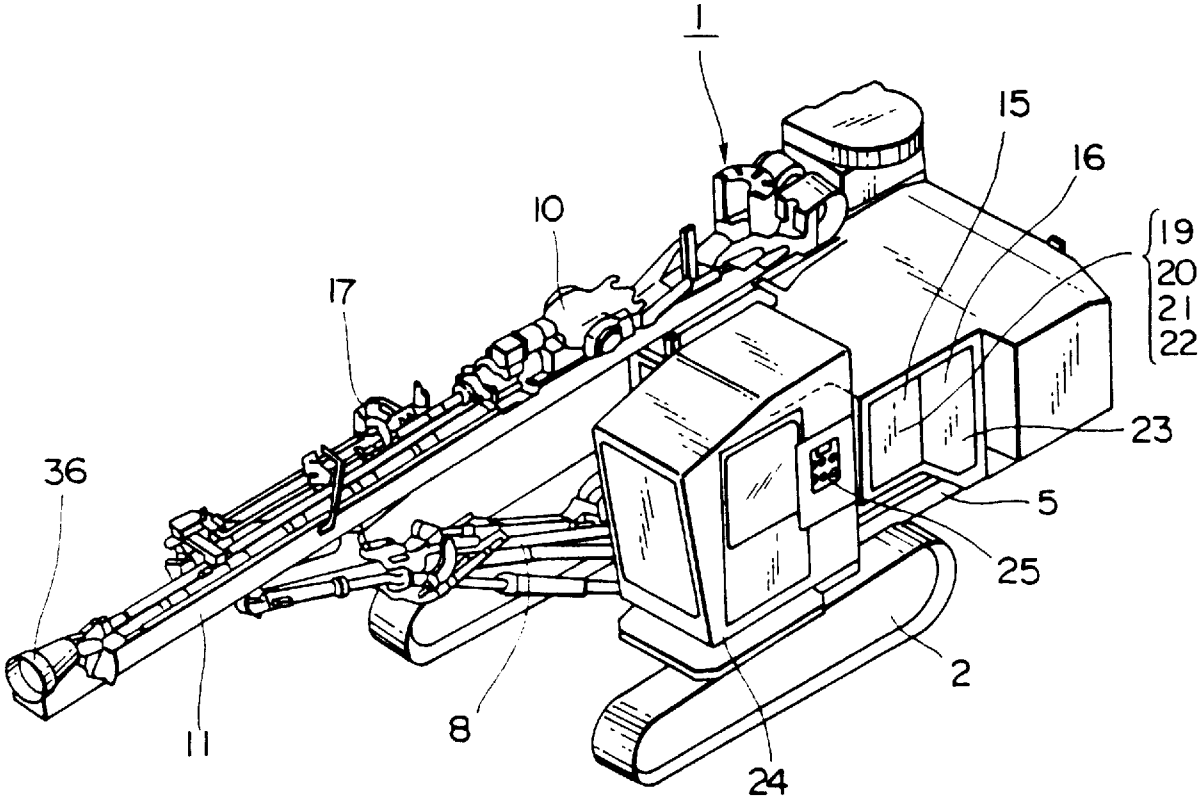
FIG. 1 is a perspective view of a hydraulic crawler drill having a drilling control apparatus of a rock drill which is one embodiment of the present invention.
Figure 2:
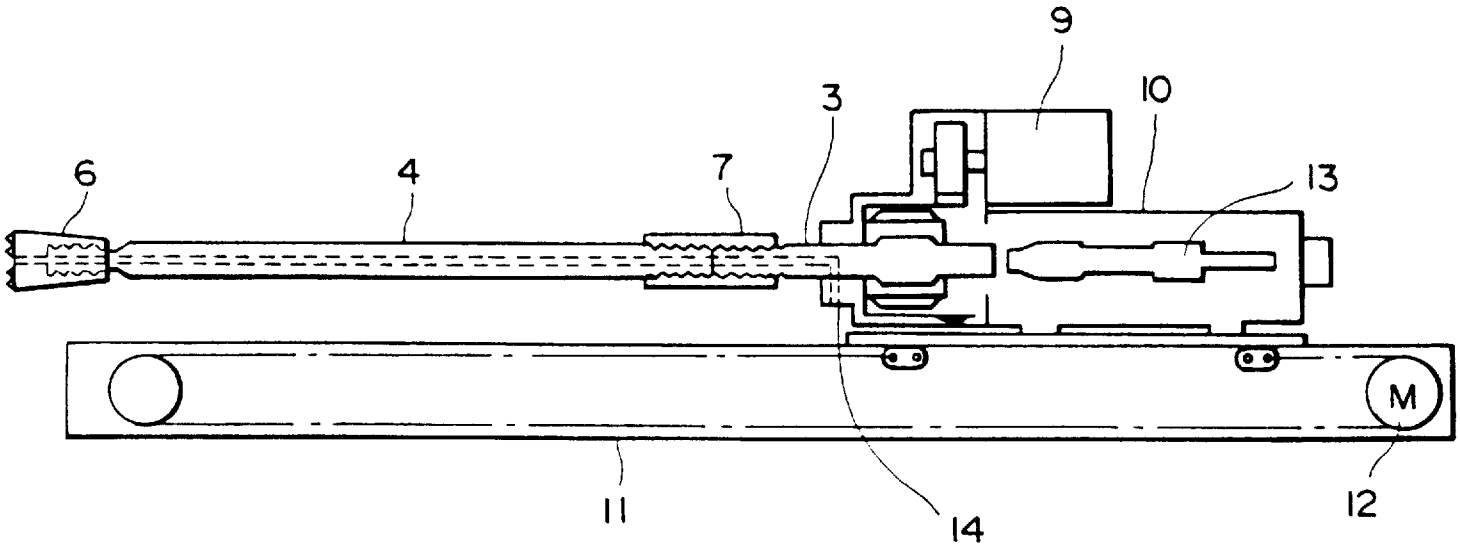
FIG. 2 is a longitudinal sectional view of the rock drill.
Figure 3:
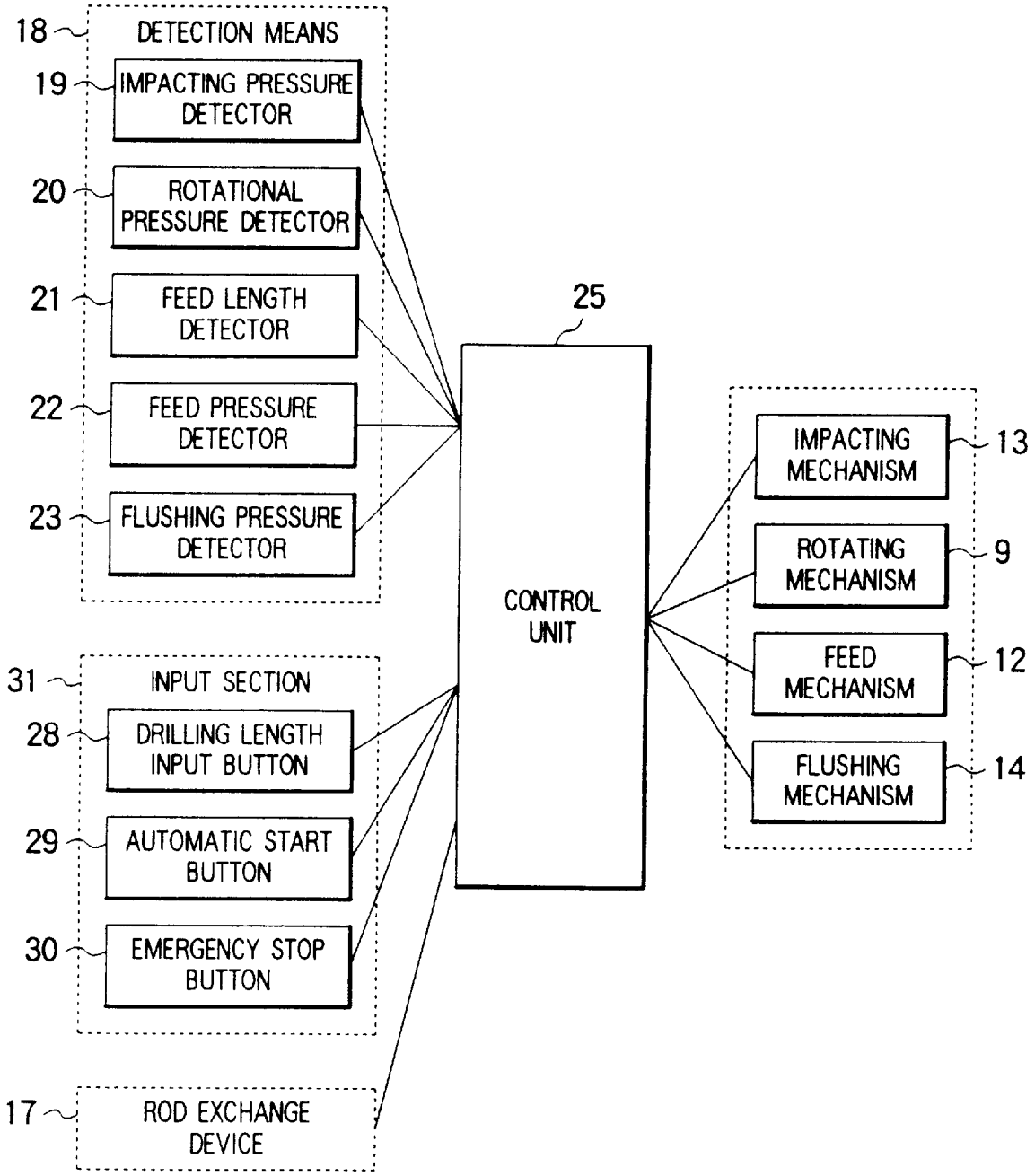
FIG. 3 is a block diagram showing an arrangement of the drilling control apparatus of the rock drill.

With reference to FIGS. 1 to 4, a hydraulic crawler drill 1 includes a boom 8 mounted on a running truck 5 provided with a truck frame 2, and the boom 8 is allowed to turn and to move upward and downward. A guide shell 11 mounting thereon a rock drill 10 is supported on an end portion of the boom 8 tiltably and swingably. A shank rod 3 is mounted on the rock drill 10, and a rod 4 of a predetermined length is connected to the shank rod 3 through a sleeve 7, and a bit 6 is attached to an end of the rod 4.

The rock drill 10 includes an impacting mechanism 13, a rotating mechanism 9 and a flushing mechanism 14, and the rock drill 10 is movable forward and backward by a feed mechanism 12 provided in the guide shell 11. The drilling of rock is performed by transmitting a striking force and a rotating force to the bit 6 through the shank rod 3 and rod 4 from the striking mechanism 13 and the rotating mechanism 9. Furthermore, the flushing mechanism 14 supplies compressed air to the end of the rod 4 to discharge dust produced by the drilling. A dust pot 36 is attached to the front end of the guide shell 11 to cover a drilling hole end, and the dust pot 36 is connected to a dust collector (not shown) to collect the discharged dust.

When the length of a hole to be drilled is longer than the length of the rod 4, since it is necessary to add a rod to the rod 4 and to recover the rod, the guide shell 11 is provided with a rod exchange device 17 for adding and recovering the rod.

On the running truck 5, as shown in FIG. 1, there are mounted with a hydraulic driving section 15 for driving the impacting mechanism 13, the rotating mechanism 9, the feed mechanism 12 and the rod exchange device 17, and an air driving section 16 for supplying the compressed air to the flushing mechanism 14. Furthermore, as detecting means 18 for detecting the striking force, rotating pressure, feed length (speed), and flushing pressure, there are provided in the hydraulic droving section 15 with an impacting force detector 19, a rotational pressure detector 20, a feed length detector 21, a feed pressure detector 22, and moreover, a flushing pressure detector 23 is provided in the air driving section 16.

Furthermore, a control unit 25 is provided in an operator cabin 24 on the running truck 5. The control unit 25 uses a computer having functions of storage, computation and control, and here, drilling data required for the control of the drilling such as drilling procedure, judgement of drilling condition, selection of drilling pattern, and the like is stored in advance.

Figure 4:
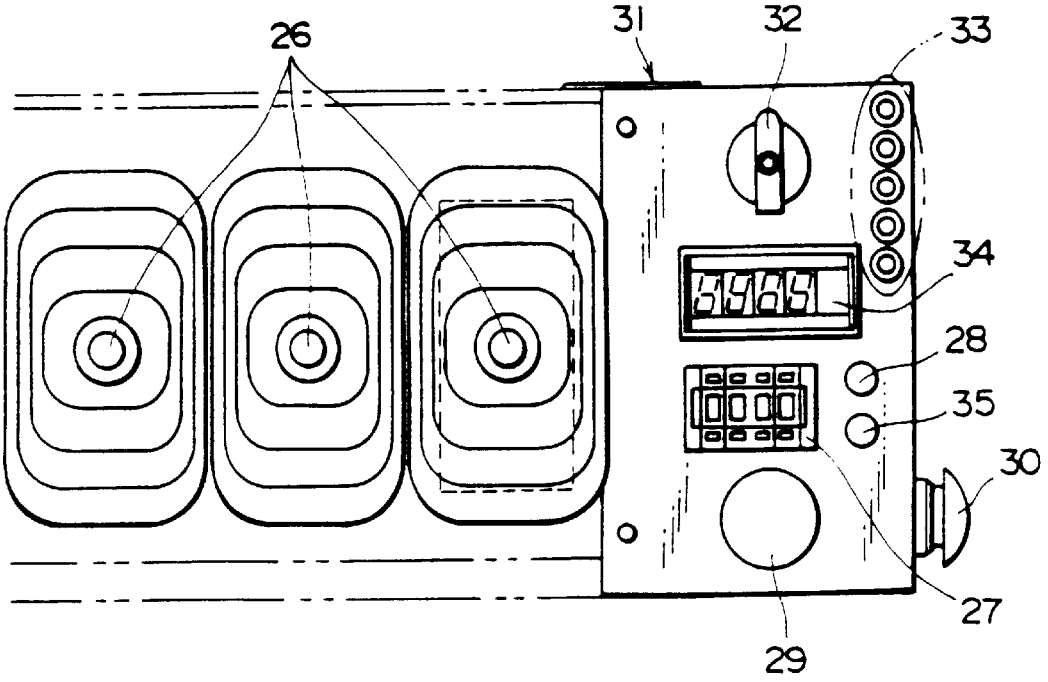
FIG. 4 is a front view of an input section of the drilling control apparatus.

Furthermore, in the vicinity of a driver's seat within the operator cabin 24, as shown in FIG. 4, there is provided adjacent to a manipulation lever 26 for manual drilling manipulation, with an input section 31 including a drilling length designation switch 27, a drilling length input button 28, an automatic start button 29, an emergency stop button 30. The input section 31 further includes a feed speed switch 32, a number of rods display device 33, a regular drilling length display device 34, and a reset button 35. The emergency stop button 30 is used to stop the operation at the time of emergency, and the feed speed switch 32 is used to manually set the feed speed. The number of rods display device 33 can always display the number of rods, and the regular drilling length display device 34 can display the drilling length during operation.

In the case of performing a drilling work by using the drilling control apparatus, the operator designates a drilling length by the drilling length designation switch 27, and sets the drilling length to the control unit 25 by depressing the drilling length input button 28. The setting of this drilling length employs an overwrite structure, and the data is semipermanently held so long as resetting is not performed by a reset button 35.

Then, if the start of drilling is commanded by depressing the automatic start button 29, the rock drill 10 starts advancement on the basis of program data of a drilling procedure stored in the control unit 25. In one example, the feed pressure is 40 Kg/cm$^2$, and the feed speed is 900 mm/min.

When the end of the bit 6 reaches the rock which is the object of crushing, the rock arrival position is detected by the feed length detector 21, and it is inputted as a zero point into the control unit 25, and thereafter, a drilling length can be obtained by using this zero point as a reference point from detection data of the feed length detector 21. The decision of the arrival at the rock is made, for example, by observing that the feed speed is zero at the feed pressure >30 kg/cm$^2$.

After the detection of the arrival at the rock, a start collaring process for positioning the end of the bit 6 is started, and when the start collaring has been performed for a predetermined length, the finish of the start collaring is detected, and a collaring process is started. After the collaring process of a predetermined length has been performed, the finish of the collaring is detected, and a real drilling process is started.

In the case of performing the drilling of a long hole, after finishing the drilling of a one-rod length, another rod is added to the rod 4 now in use, and after performing a collaring after the addition of the rod, the regular drilling is performed again. Thereafter, the drilling and the addition to the rod 4 are repeated. When the drilled length reaches the designated length, the drilling is finished.

Figure 5:
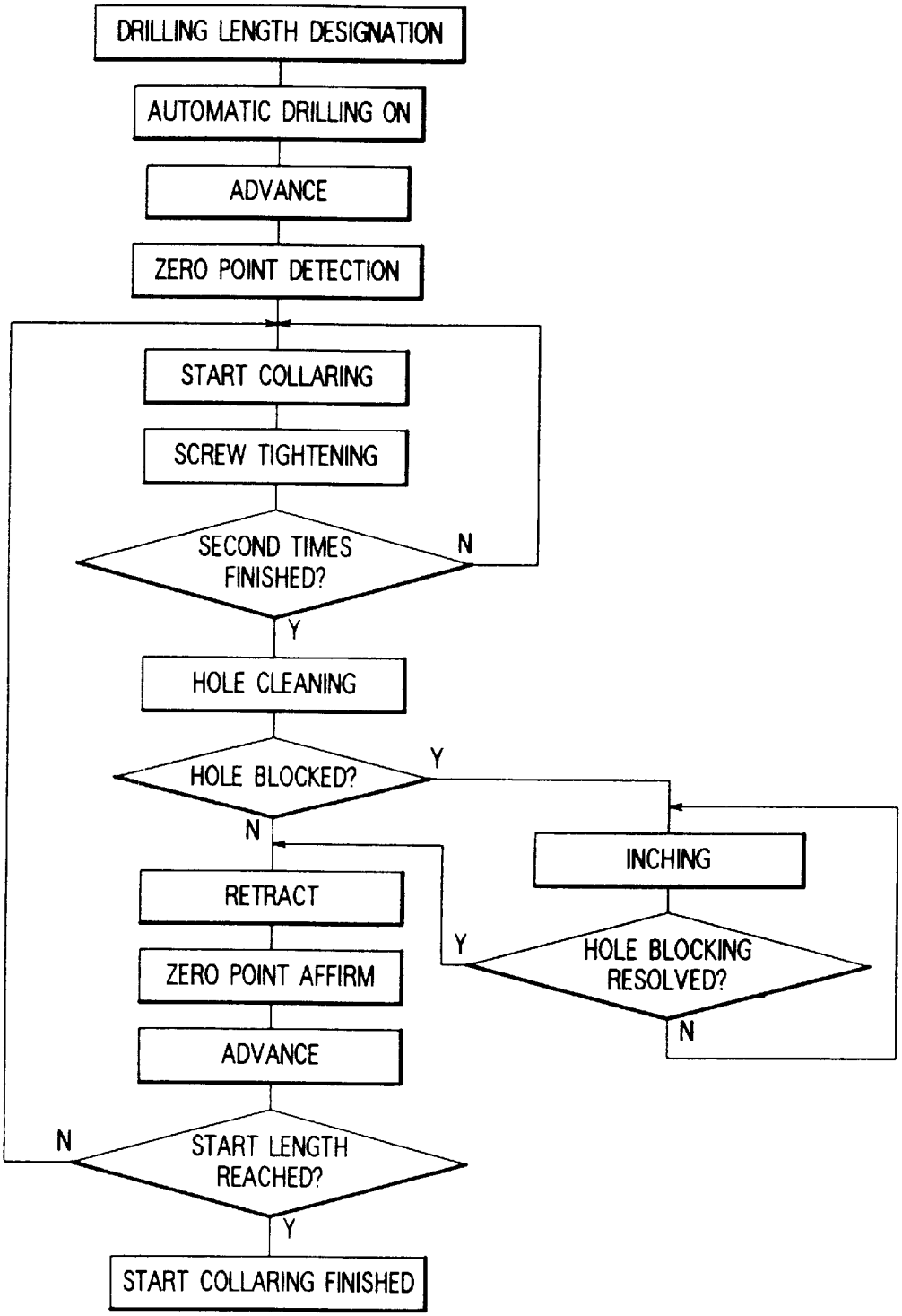
FIG. 5 is a flowchart showing an example of a start collaring process.

The start collaring is performed by a procedure as shown in FIG. 5. For the drilling conditions at this time, an appropriate pattern is selected from various patterns stored in the control unit 25 depending on the angle of arrival at the rock and the kind of the rock. In one example, the start collaring is performed after detecting the zero point, at an impacting pressure of 120 kg/cm$^2$, a feed pressure of 20 kg/cm$^2$, a feed speed of 900 mm/min, the dust collector is turned ON, and by applying the striking force in an advancing direction for 3 seconds, and subsequently, screw fastening is performed at a rod rotational speed of 100 rpm for 0.8 seconds, and this is repeated for 2 times.

Next, the hole cleaning is performed for 3 seconds at a rod rotational speed of 100 rpm with weak flushing and the dust collector being turned ON, and the blockade of the hole is confirmed. It the flushing pressure is 7 kg/cm$^2$ or larger, it is judged that the hole is blocked, and the inching of 1 second is repeated at an impacting pressure of 120 kg/cm$^2$, a feed pressure of 20 kg/cm$^2$, a feed speed of 900 mm/min, strong flushing and the dust collector being turned ON. If the flushing pressure reduces to 6 kg/cm$^2$ or lower, it is judged that the hole blockade is resolved, and after retracting the rock drill 10 to the zero point, it is advanced at a feed pressure of 30 kg/cm$^2$, a feed speed of 900 mm/min, a rod rotational speed of 100 rpm, and the dust collector being turned ON, and after confirming the drilled length, and if a predetermined start drilling length, for example, 200 mm is reached, the start collaring is finished.

Figure 6:
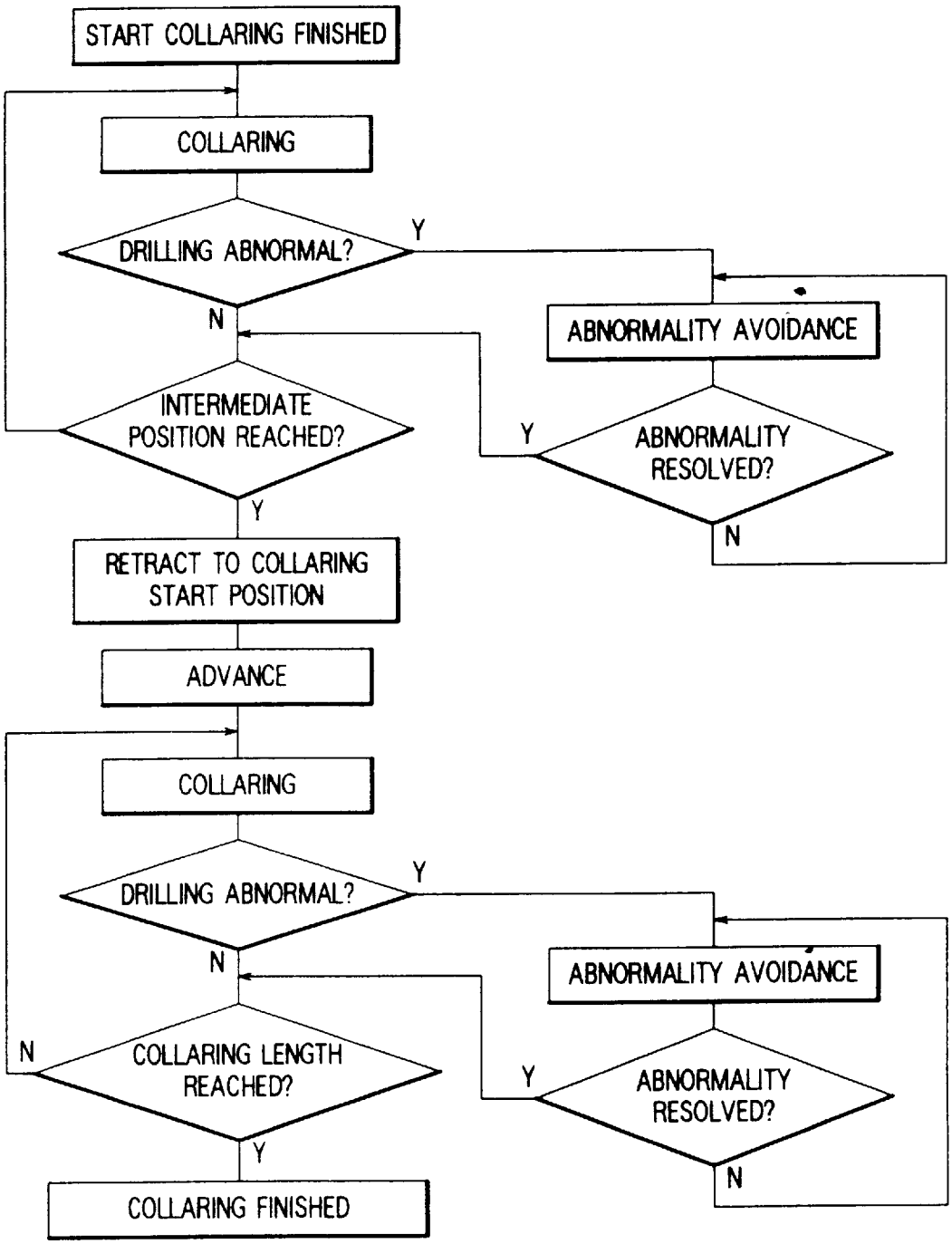
FIG. 6 is a flowchart showing an example of a collaring process.

When the finish of the start collaring is detected, a collaring process is started. The collaring process is performed in a procedure as shown in FIG. 6. Also for drilling conditions at this time, an optimum pattern is selected from various patterns stored in the control unit 25.

In one example, the collaring operation is performed at an impacting pressure of 120 kg/cm$^2$, a feed pressure of 30 kg/cm$^2$, a feed speed of 900 mm/min, a rod rotational speed of 100 rpm, weak flushing and the dust collector being turned ON, and a drilling length is confirmed, and if the drilling length reaches an intermediate position of collaring for example, a drilling length of 400 mm, the rock drill 10 is once retracted with fast feed to the start position of the collaring at a rod rotational speed of 100 rpm, weak flushing and the dust collector being turned ON. Thereafter, the collaring operation is performedagain at an impacting pressure of 120 kg/cm$^2$, a feed pressure of 30 kg/cm$^2$, a feed speed of 900 mm/min, a rod rotational speed of 100 rpm, weak flushing and the dust collector being turned ON, and a drilling length is confirmed, and if the drilling length reaches a predetermined collaring length of, for example, 700 mm, the collaring is finished.

During the collaring process, if it is judged that abnormality is caused in the drilling operation such as an increase in rotational resistance and a bit hole blockade as detected from the detection data showing an increase of the rotational pressure and an increase of the flushing pressure from the detection means 18, the control unit 25 makes the process shift to an abnormality avoiding process.

In the abnormality avoiding process, for example, the rock drill 10 is made to retract in fast feed at a rod rotational speed of 100 rpm with the dust collector being turned ON, and if the abnormality is resolved, the rock drill 10 returns to the original drilling condition.

When the finish of the collaring is detected, the real drilling process is started. During the collaring the drilling data including the impacting pressure, the rotational pressure, the feed length (speed), the feed pressure, and the flushing pressure is detected by each detector 19, 20, 21, 22, and 23, and stored in the control unit 25. Data of the drilling patterns of hard rock drilling, medium-hard rock drilling, soft rock drilling, clay layer drilling, crushing region drilling, and the like is stored in the control unit 25 so that an optimum drilling work can be performed depending on the property of the rock. The control unit 25 judges the property of the rock on the basis of the detection data at the time of the collaring and the conditions for the drilling operation at the time of starting the regular drilling are set.

Figure 7:
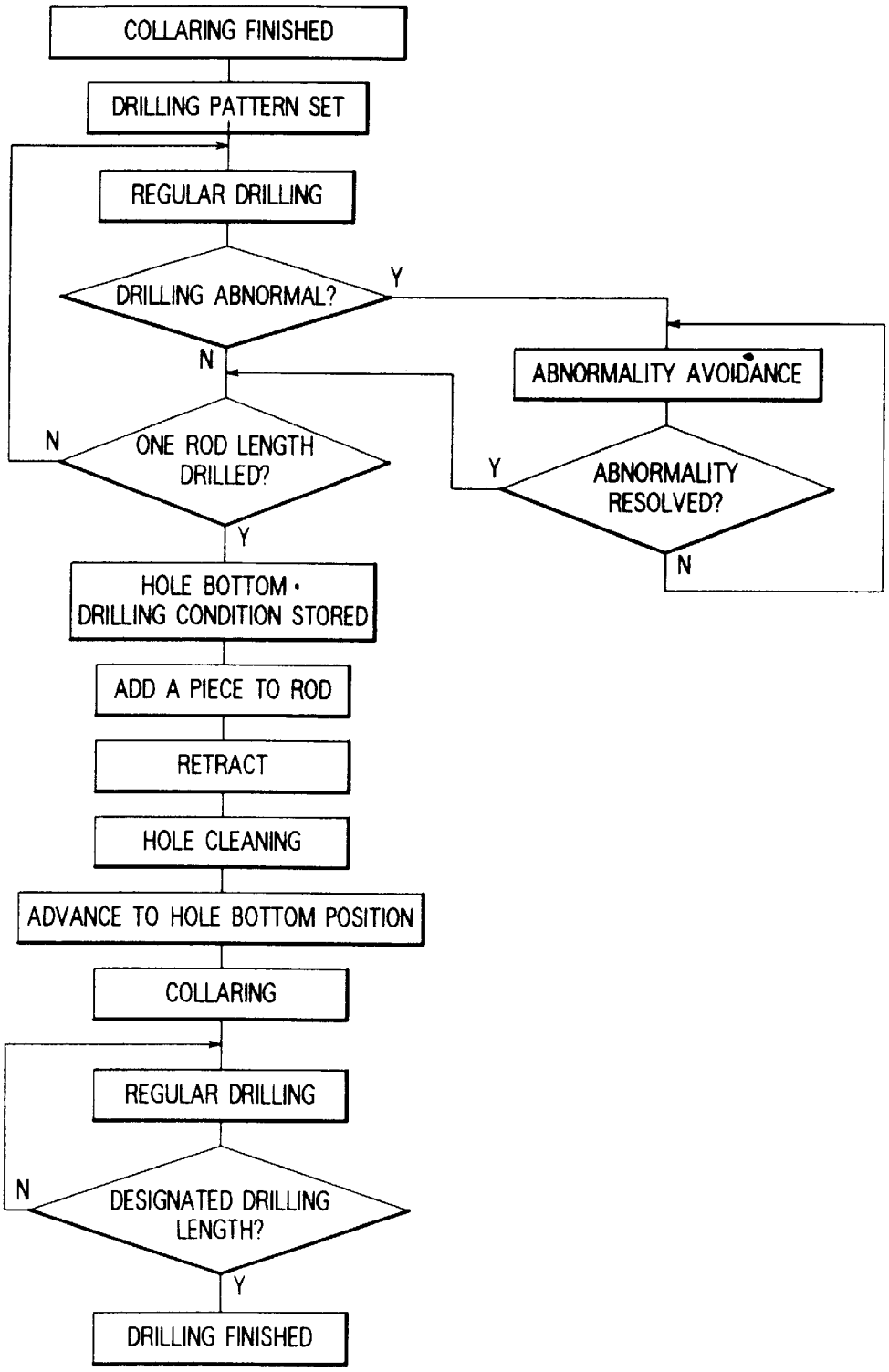
FIG. 7 is a flowchart showing an example of a regular drilling process.

The regular drilling process is performed in a procedure as shown in FIG. 7. In one example of hard rock drilling, the regular drilling operation is started at an impacting pressure of 120 kg/cm$^2$, a feed pressure of 90 kg/cm$^2$, a feed speed of 900 mm/min, a rod rotational speed of 100 rpm, strong flushing and the dust collector being turned ON.

During the regular drilling, the drilling data including the impacting pressure, the rotational pressure, the feed length (speed), the feed pressure, and the flushing pressure is detected by each detector 19, 20, 21, 22, and 23 of detecting means 18, and stored in the control unit 25. The control unit 25 always judges the condition such as hard or soft of the rock, the presence or absence of a crack, and the like on the basis of the detection data, and if there is a change in the condition, the setting of the drilling conditions is changed. For example, a change in the property of the rock is judged by the detection data of the rotational pressure, the flange pressure, the drilling speed, etc., and if the rotational pressure, the flange pressure, the drilling speed, etc., are increased, the process is shifted to another appropriate drilling pattern such as a medium-hard rock drilling pattern, a soft rock drilling pattern, a clay layer drilling pattern, a crush region drilling pattern, and the like.

When the rotational pressure, the flushing pressure, the drilling speed, and the like are decreased, the feed pressure and the impacting pressure are made to increase.

In the real drilling process, when the control unit 25 judges on the basis of the detection data including an increase in rotational pressure and an increase in flushing pressure, and the like, that abnormality in the drilling operation such as an increase in rotational resistance and a bit hole blockade has occurred, the control unit 25 makes the process shift to an abnormality avoiding process.

In the abnormality avoiding process, the rock drill 10 is retracted with fast feed, for example, at a rod rotational speed 100 rpm, strong flushing and the dust collector being turned ON, and when the abnormality is resolved, the process returns to the original drilling condition.

When the designated drilling length is longer than one rod length, after finishing the drilling of one rod length, another rod is added to the rod 4 in the rod exchanging device 17.

After finishing the addition to the rod 4, the collaring is performed. In the collaring after the addition of the rod, for example, the rock drill 10 is retracted with fast feed to the rear end of the guide shell 11 at a rod rotational speed 100 rpm, strong flushing and the dust collector being turned ON, and then, the rock drill 10 is advanced to a position 200 mm before the hole bottom at a striking pressure of 120 kg/cm$^2$, a feed pressure of 30 kg/cm$^2$, a feed speed of 900 mm/min, a rod rotational speed 100 rpm, strong flushing and the dust collector being turned ON, and hole cleaning is performed. After confirming that there is no abnormality such as jamming or the like, the rock drill 10 is again advanced to the hole bottom position at an impacting pressure of 120 kg/cm$^2$, a feed pressure of 30 kg/cm$^2$, a feed speed of 900 mm/min, a rod rotational speed 100 rpm, strong flushing and the dust collector being turned ON.

Thereafter, the rock drill 10 is advanced to perform the collaring operation at an impacting pressure of 120 kg/cm$^2$, a feed pressure of 20 kg/cm$^2$, a feed speed of 900 mm/min, a rod rotational speed 100 rpm, strong flushing and the dust collector being turned ON. By confirming the drilling length, if a predetermined collaring length, for example, advancement of 50 mm from the bottom position, has been drilled, the collaring finished.

When the collaring after the addition of the rod is finished, the real drilling is started. The control unit 25 stores during temporary stopping of the drilling operation for the addition of the rod, the drilling condition before the stopping, and at the time of restarting the real drilling, it is possible to set the conditions for the drilling operation similarly to that before the stopping and to restart the real drilling operation.

Thereafter, the drilling and the addition of the rod are repeated, and when the designated drilling length is reached, the drilling is finished.

As described above, the control unit 25 can automatically control the drilling operation from its start until the finishing without requiring cumbersome manipulation by the manipulation levers 26 and switches at the driver's seat by the operator. As a result, the fatigue of the operator can be reduced to a great extent. Furthermore, the drilling work is not affected by the individual difference depending on the skill level, and the drilling efficiency and the drilling precision including the linearity and the finished condition of the hole wall are improved.

Since the conditions for the drilling operation at the start of the real drilling are set by the control unit 25 by judging the property of the rock on the basis of the detection data at the time of collaring, it is possible to immediately perform the appropriate real drilling.

The control unit 25 judges during the drilling the presence or absence of the abnormality such as the increase of rotational resistance, the bit hole blockade, and the like on the basis of detection data including the increase in rotational pressure, the increase in flushing pressure, and the like, and at the time of abnormality, makes the rock drill 10 operate the operation to avoid the abnormality such as the retraction and the like. Accordingly, it is possible to prevent the expansion of the failure in the drilling and to return the rock drill 10 to the normal drilling condition at an early stage.

The control unit 25 stores during temporary stopping of the drilling operation, the drilling condition before the stopping, and sets the conditions for the drilling operation at the time of restarting the drilling operation similarly to that before the stopping. As a result, even when the drilling operation is temporary stopped due to the adding work of the rod, it is possible to restart the drilling work in an appropriate condition.

As described in the foregoing, in the control apparatus of a rock drill in the present invention, since the drilling control is automated, it is possible to reduce the fatigue of the operator, and to achieve the stable drilling precision and the drilling efficiency without being affected by the skill level of the operator.

We claim:

1. A drilling control apparatus of a rock drill having a first drill rod comprising:

detection means for detecting an operating condition of an impacting mechanism, a rotating mechanism, a feed mechanism, and a flushing mechanism of the rock drill mounted movably forward and backward on a guide shell;

a control unit for controlling a drilling operation of the rock drill by storing required drilling data and by judging a drilling condition on the basis of detection data from said detection means; and a rod exchange device for adding a second drill rod when a length of a hole to be drilled is longer than a length of the first rod, thereby to enable to drill a hole automatically to a predetermined depth even when the predetermined depth is larger than the first drill rod.

2. A drilling control apparatus according to claim 1, wherein said control unit sets conditions for a drilling operation at a time of starting regular drilling on the basis of detection data obtained during collaring.

3. A drilling control apparatus according to claim 1 or 2, wherein said control unit judges during drilling the presence or absence of abnormality on a basis of detection data, and makes the rock drill operate an operation to avoid the abnormality.

4. A drilling control apparatus according to claim 1, 2, or 3, wherein said control unit, during temporary stopping of the drilling operation, stores a drilling operation before the stopping and sets conditions for the drilling operation at a time of restarting the drilling operation similarly to that before the stopping.

5. The drilling control apparatus according to claim 1 further comprising means for displaying the number of rods used during the drilling operation.

6. A drilling control apparatus for a rock drill having a bit at one end of a drill rod for drilling into a rock, the apparatus comprising:

means for continually monitoring the operating condition of the rock drill;

means for adjusting the operation of the rock drill;

means for detecting an arrival position of the rock when the bit first communicates with the rock;

means for determining the presence of an abnormality in the drilling operation; and means for adding drilling length to the drill rod.

7. The control apparatus of claim 6, further comprising a data retrieval storage area for storing various predetermined drilling patterns.

8. The control apparatus of claim 7, further comprising means for selecting the appropriate drilling pattern for the rock drill from the stored predetermined drilling patterns.

9. The control apparatus of claim 7, further comprising:

means for detecting a change in the property of the rock.

* * * * *